US008289108B2

(12) United States Patent
Reddy et al.

(10) Patent No.: US 8,289,108 B2
(45) Date of Patent: Oct. 16, 2012

(54) THERMALLY EFFICIENT DIELECTRIC RESONATOR SUPPORT

(75) Inventors: Raja K Reddy, Cheshire, CT (US); Yin-Shing Chong, Middletown, CT (US)

(73) Assignee: Alcatel Lucent, Paris (FR)

( * ) Notice: Subject to any disclaimer, the term of this patent is extended or adjusted under 35 U.S.C. 154(b) by 425 days.

(21) Appl. No.: 12/609,919

(22) Filed: Oct. 30, 2009

(65) Prior Publication Data

US 2011/0102109 A1 May 5, 2011

(51) Int. Cl.
*H01P 1/201* (2006.01)
*H01P 7/10* (2006.01)

(52) U.S. Cl. ..... 333/202; 333/219.1; 333/234

(58) Field of Classification Search ..... 333/202, 333/219.1, 234, 229
See application file for complete search history.

(56) References Cited

U.S. PATENT DOCUMENTS

| | | | | |
|---|---|---|---|---|
| 4,028,652 | A * | 6/1977 | Wakino et al. | 333/209 |
| 4,667,172 | A * | 5/1987 | Longshore et al. | 333/134 |
| 5,323,129 | A * | 6/1994 | Harris | 333/219.1 |
| 5,714,920 | A | 2/1998 | Ivanov et al. | |
| 6,262,639 | B1 * | 7/2001 | Shu et al. | 333/202 |
| 6,529,094 | B1 | 3/2003 | Kubo et al. | |
| 6,600,394 | B1 * | 7/2003 | Wang et al. | 333/235 |
| 8,031,036 | B2 * | 10/2011 | Panariello et al. | 333/219.1 |
| 2004/0257176 | A1 | 12/2004 | Pance et al. | |

OTHER PUBLICATIONS

International Search Report dated Feb. 25, 2011 for corresponding PCT Application No. PCT/US2010/053660.

* cited by examiner

*Primary Examiner* — Seungsook Ham
(74) *Attorney, Agent, or Firm* — Kramer & Amado, PC

(57) ABSTRACT

Various exemplary embodiments relate to a temperature compensation structure for use in a dielectric resonator that permits a support to be thermally efficient in rapidly transferring heat generated by a central puck in the resonator. The temperature compensation structure may have an extension shaped to promote heat from the puck into the support, thereby permitting high power operation of the dielectric resonator without overheating.

20 Claims, 5 Drawing Sheets

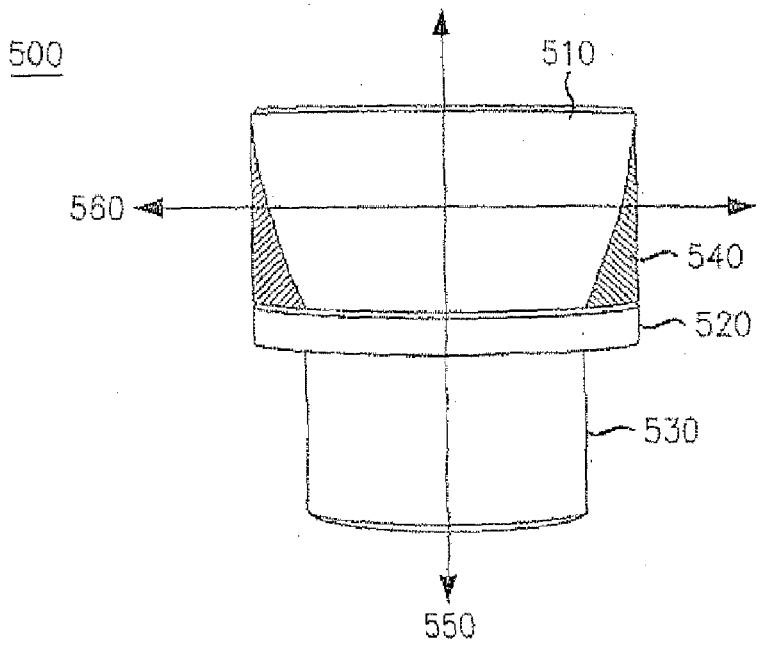
*FIG.* 5
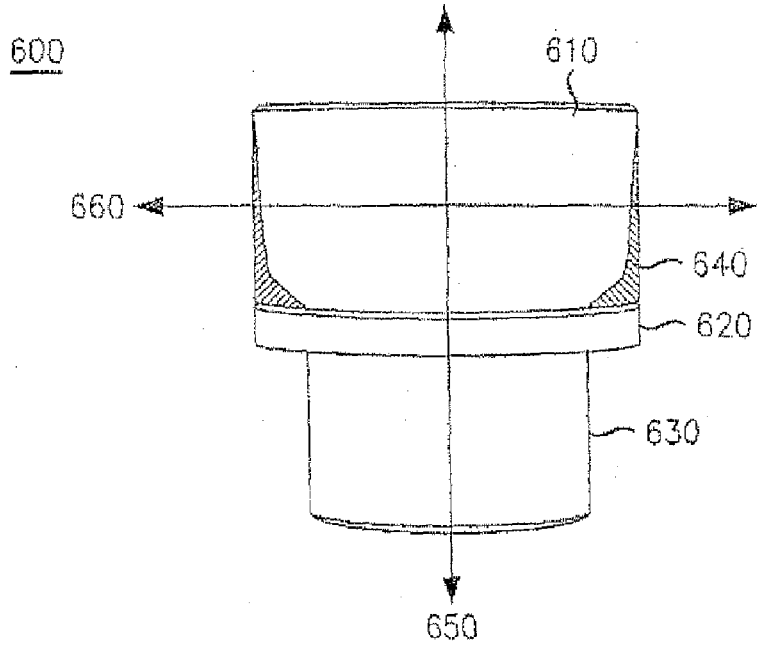
*FIG.* 6

THERMALLY EFFICIENT DIELECTRIC RESONATOR SUPPORT

TECHNICAL FIELD

Embodiments disclosed herein relate generally to a thermally efficient structure for transferring heat during operation of a dielectric resonator.

BACKGROUND

A dielectric resonator is an electronic component that exhibits resonance for a narrow range of frequencies, generally in the microwave band. Resonators are used in, for example, radio frequency communication equipment. In order to achieve the desired operation, many resonators include a "puck" disposed in a central location within a cavity that has a large dielectric constant and a low dissipation factor.

The combination of the puck and the cavity imposes boundary conditions upon electromagnetic radiation within the cavity. The cavity has at least one conductive wall, which may be fabricated from a metallic material. A longitudinal axis of the puck may disposed substantially perpendicular to an electromagnetic field within the cavity, thereby controlling resonation of the electromagnetic field.

When the puck is made of a dielectric material, such as ceramic, the cavity may resonate in the transverse electric (TE) mode. Thus, there may be no electric field in the direction of propagation of the electromagnetic field. While many TE modes may be used, dielectric resonators may use the TE011 mode for applications involving microwave frequencies. Using the TE011 mode as an exemplary case, the electric field will reach a maximum within the puck, have an azimuthal component along a central axis of the puck, generally decrease in the cavity away from the puck, and vanish entirely along any conductive cavity wall. The magnetic field will also reach a maximum within the puck, but will lack an azimuthal component.

While the dielectric resonator will store an electromagnetic field, it may also produce a considerable amount of heat. Coupling the puck to another object may compensate for overheating. When two solid bodies come in contact, heat flows from the hotter body to the colder body. As this flow is not instantaneous, a temperature drop occurs at the interface between the two surfaces in contact. The ratio between this temperature drop and the average heat flow across the interface is known as the "thermal contact resistance." When this resistance is minimized, heat flows rapidly.

Consequently, a dielectric resonator may use a "support" for heat transfer, such that heat is transferred from the puck to the support and out of the resonator. A designer would characterize the material in the support by its thermal conductivity, a parameter that measures its ability to conduct heat. Unfortunately, materials with very high thermal conductivity and very low electrical conductivity are often prohibitively expensive for use in such supports. As a result, current implementations fail to effectively radiate heat to the external environment, particularly in high power applications, thereby resulting in impaired operation or failure of resonators due to overheating.

Accordingly, there is a need for a thermally efficient, cost-effective support for a dielectric resonator. In particular, there is a need for a support that has relatively low thermal contact resistance, permitting rapid transfer of heat, but also has electrical characteristics that would not interfere with the operation of the resonator. Conventional techniques can only drain generated heat slowly, so they are not suitable for dielectric resonators used in high power operations that may produce rapid temperature spikes in the central pucks.

SUMMARY

In light of the present need for a thermally efficient, cost-effective dielectric resonator support, a brief summary of various exemplary embodiments is presented. Some simplifications and omissions may be made in the following summary, which is intended to highlight and introduce some aspects of the various exemplary embodiments, but not to limit the scope of the invention. Detailed descriptions of a preferred exemplary embodiment adequate to allow those of ordinary skill in the art to make and use the inventive concepts will follow in later sections.

In various exemplary embodiments, a system for heat transfer in a communication device may include a dielectric resonator that generates heat when the communication device is active. The dielectric resonator may, in turn, include a puck having a top surface and a bottom surface that is located within a cavity defined by at least one conductive wall, wherein the puck does not contact the at least one conductive wall. The dielectric resonator may also include a temperature compensation structure having an upper surface and a lower surface that transfers the generated heat away from the dielectric resonator by having the upper surface in contact with the bottom surface of the puck. To maximize heat transfer, the upper surface of the temperature compensation structure and the bottom surface of the puck may have substantially equal surface areas. Finally, the resonator may include a support below the temperature compensation structure that receives transferred heat from the lower surface of the temperature compensation structure. The support may contact the conductive wall and have a vertical axis perpendicular to a horizontal axis in the puck.

In various exemplary embodiments, a dielectric filter having thermally efficient heat transfer may comprise a plurality of dielectric resonators and an aperture between the plurality of dielectric resonators. Each of the dielectric resonators may comprise a cavity defined by at least one conductive wall, a puck having a top surface, and a bottom surface that is located within the cavity. No portion of the puck may contact the at least one conductive wall. A temperature compensation structure having an upper surface and a lower surface may transfer the generated heat away from the dielectric filter by having its upper surface in contact with the bottom surface of the puck. The upper surface of the temperature compensation structure and the bottom surface of the puck may have substantially equal surface areas. A support below the temperature compensation structure may receive transferred heat from the lower surface of the temperature compensation structure. The support may contact the conductive wall and have a vertical axis perpendicular to a horizontal axis in the puck.

Accordingly, various exemplary embodiments provide an improved way to remove generated heat from a dielectric resonator. These embodiments may allow a puck to rapidly transfer heat into a support, preventing the puck from overheating. These embodiments may also allow inexpensive materials to be used in a thermally efficient manner, thereby reducing overall cost of a communication system.

BRIEF DESCRIPTION OF THE DRAWINGS

In order to better understand various exemplary embodiments, reference is made to the accompanying drawings, wherein:

FIG. 5 shows a side view of a fourth exemplary dielectric resonator;

FIG. 6 shows a side view of a fifth exemplary dielectric resonator; and

DETAILED DESCRIPTION

Figure 1:
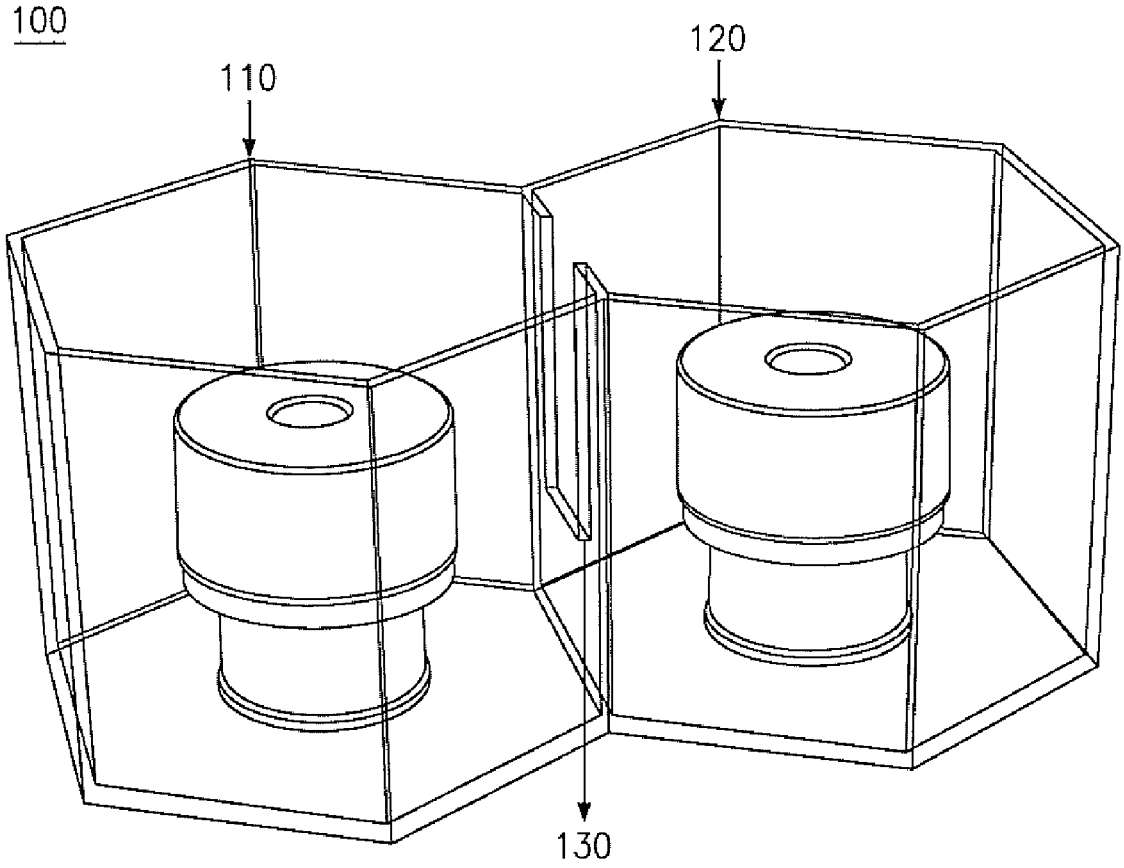
FIG. 1 shows a perspective view of an exemplary dielectric filter.

Referring now to the drawings, in which like numerals refer to like components or steps, there are disclosed broad aspects of various exemplary embodiments.

FIG. 1 is a perspective view of an exemplary dielectric filter 100. As shown in FIG. 1, filter 100 comprises a first dielectric resonator 110 and a second dielectric resonator 120. An aperture 130 connects the first dielectric resonator 110 to the second dielectric resonator 120. Exemplary structures for the first dielectric resonator 110 and the second dielectric resonator 120 are described in detail below with reference to FIGS. 2-6. While exemplary filter 100 has only two dielectric resonators, one of ordinary skill in the art may design filter 100 to have an arbitrary number of dielectric resonators, depending upon the applicable environment for the filter.

FIG. 1 depicts first dielectric resonator 110 and second dielectric resonator 120 as hexagonal prisms. Thus, first dielectric resonator 110 and second dielectric resonator 120 are semiregular polyhedra having eight faces. Two of the faces are hexagonal while six of the faces are rectangular. It should be apparent, however, that one of ordinary skill in the art could design filter 100 to use dielectric resonators having other shapes. Alternative forms include, for example, spheres, ellipses, cylinders, cones, rings, and cubes. Dielectric resonators may also have polyhedral shapes other than hexagonal prisms.

In each embodiment, at least one metallic wall may totally enclose the volume of first dielectric resonator 110 and second dielectric resonator 120. Thus, an appropriate stimulus could cause the enclosed volume to resonate, allowing first dielectric resonator 110 and second dielectric resonator 120 to become sources of electromagnetic oscillations. Aperture 130 may function as a tuner for these oscillations, thereby permitting filter 100 to generate electromagnetic signals within an appropriate frequency range.

The need for tuning is particularly acute when operation of the dielectric resonator may occur within a predefined range of frequencies. High power dielectric resonators may be widely used in applications, such as wireless broadcasting of video, audio, and other multimedia from a tower to a receiver. In current implementations in the United States, such technologies may transmit signals over a frequency spectrum of 716-722 MHz. Thus, couplers may require accurate tuning within this spectral range.

Figure 2:
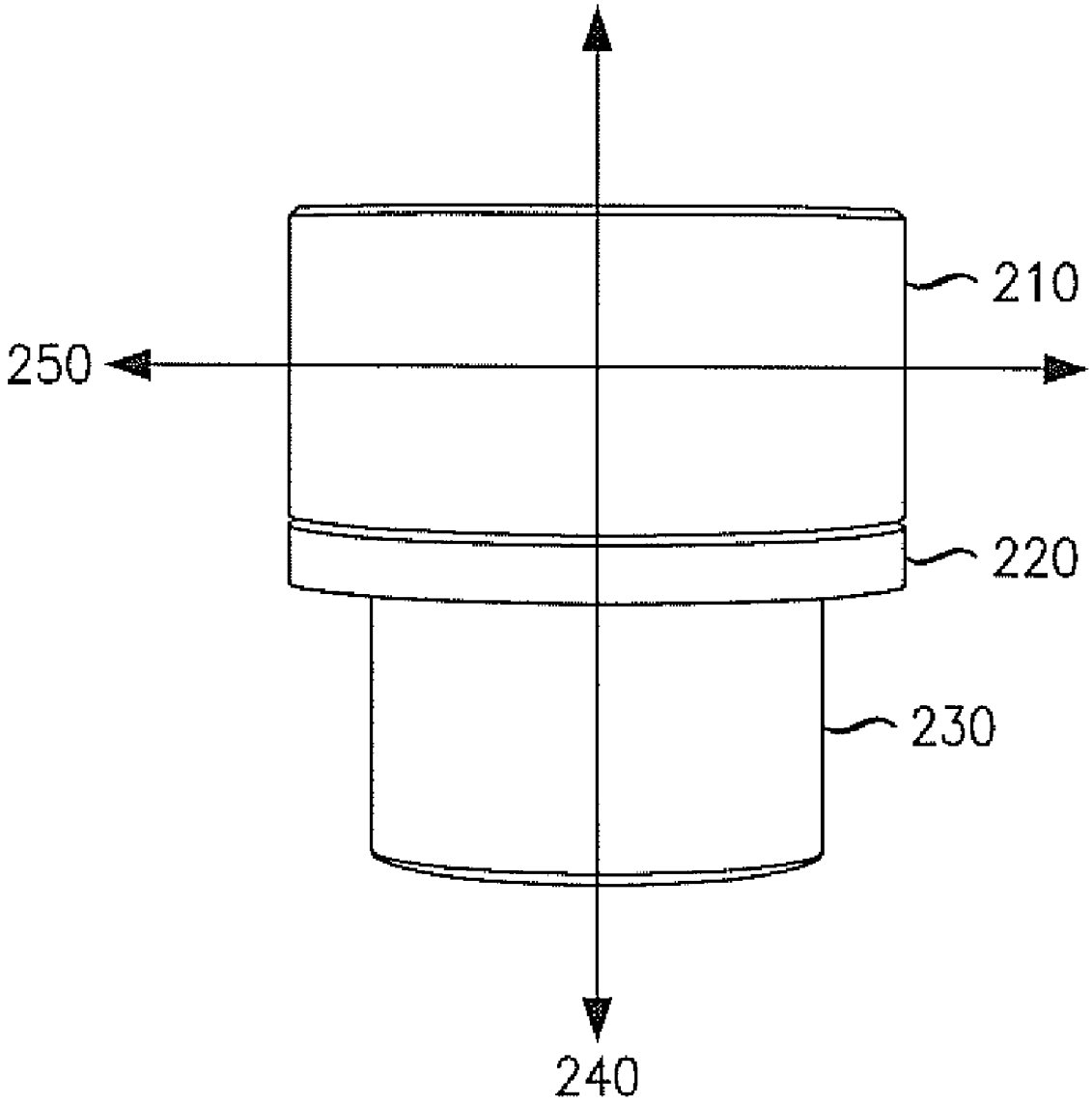
FIG. 2 shows a side view of a first exemplary dielectric resonator.

FIG. 2 shows a side view of a first exemplary dielectric resonator 200. Resonator 200 may include a puck 210, a temperature compensation structure 220, and a support 230.

Puck 210 may be made of ceramic or another suitable material, as will be apparent to those having ordinary skill in the art. The overall physical dimensions of puck 210 and the dielectric constant of its material may determine the resonance frequency of dielectric resonator 200. In general, puck 210 may be made of a material having a large dielectric constant and a low dissipation factor, such as the exemplary ceramic compounds $BaCe_2Ti_5O_{15}$ and $Ba_5Nb_4O_{15}$.

Even though puck 210 may have a low dissipation factor, any dielectric material has a loss tangent, a parameter that measures the material's tendency to dissipate electromagnetic energy. Thus, while the dielectric resonator 200 operates, a portion of its electromagnetic energy will turn into heat. If this heat is not radiated to the external environment at a sufficient rate, the temperature of the dielectric resonator 200 may rise excessively. Such overheating may impair the operation of the dielectric resonator 200 or even damage it.

Accordingly, dielectric resonator 200 may include a temperature compensation structure 220, which receives the generated heat from puck 210 and transfers the received heat to support 230. Temperature compensation structure 220 may be in contact with puck 210 to achieve this heat transfer. Thus, temperature compensation structure 220 may be glued to puck 210 with a thermally conductive adhesive with an appropriate dielectric constant. Alternatively, temperature compensation structure 220 may be attached to puck 210 with other mechanical means that will be apparent to those of skill in the art (e.g., clamp, screw, bolt, etc.). Temperature compensation structure 220 may be integral with support 230 or constitute a separate component attached to support 230 in some manner.

In the illustrated embodiment, support 230 is cylindrical, having an internal surface contacting a proximal surface of puck 210. The proximal surface of puck 210 is a surface of puck 210 that is close to temperature compensation structure 220 and support 230, while a distal surface of puck 210 is away from temperature compensation structure 220 and support 230.

While FIG. 2 depicts puck 210 as above temperature compensation structure 220 and support 230, an alternative embodiment could have temperature compensation structure 220 and support 230 above puck 210. In another alternative, temperature compensation structure 220 and support 230 could be disposed to the left or right of puck 210. In yet another alternative, temperature compensation structure 220 and support 230 could be disposed to the front or back of puck 210. In general, a surface of temperature compensation structure 220 and support 230 facing puck 210 may be called an "internal" surface, because such surfaces are directed toward the center of the cavity. Conversely, a surface facing away from puck 210 may be called an "external" surface, because such surfaces point toward the cavity's conductive wall.

In addition, dielectric resonator 200 may have a plurality of supports, disposed at various locations within its cavity. For example, a second support may be disposed on an opposite side of puck 210 relative to support 230. In this example, puck 210 might be in the middle of a top support and a bottom support.

Thermal spreading resistance may impede transfer of heat when two objects have different sizes. Thus, to promote efficient transfer of heat, the contiguous portions of puck 210 and temperature compensation structure 220 may have substantially equal surface areas. Because the contiguous surface areas are similar, thermal spreading resistance to heat flowing from puck 210 into temperature compensation structure 220 may be minimal.

Support 230 may be coupled to temperature compensation structure 220 in a manner that support 230 transfers received heat. Support 230 may also be cylindrical in shape, having its internal surface contacting an external surface of temperature compensation structure 220. Alternatively, as described above, temperature compensation structure 220 and support 230 may be a single unit. A vertical axis 240 of support 230 may be perpendicular to a horizontal axis 250 of puck 210.

Temperature compensation structure 220 and support 230 may both have sufficient thermal conductivity to transfer heat from puck 210 to the external environment. Thermal conductivity, k, measures the ability of a material to conduct heat and is typically measured by power (Watts) transferred over a distance (meters) at a given temperature (Kelvins).

Thus, selection of a material for temperature compensation structure 220 and support 230 may be made based on an amount of thermal energy radiated by puck 210. As detailed above, in a typical implementation, ceramic may be used. Other suitable materials with relatively high thermal conductivity and relatively low electrical conductivity will be apparent to those of skill in the art. For example, pure diamond, an allotrope of carbon, has a thermal conductivity as high as 2320 W/mK and, although very expensive, may be used for temperature compensation structure 220 or support 230. Beryllium oxide (BeO) and aluminum nitride (AlN) are other suitable, but expensive, examples.

Alumina ($Al_2O_3$) has low dielectric loss and high thermal conductivity relative to other ceramics. Furthermore, alumina has a positive dielectric temperature coefficient with respect to that of conventional ceramics. Thus, alumina may be an effective support material for dielectric resonator 200. Again, other materials could be used for temperature compensation structure 220 and support 230, as will be apparent to those having ordinary skill in the art.

Figure 3:
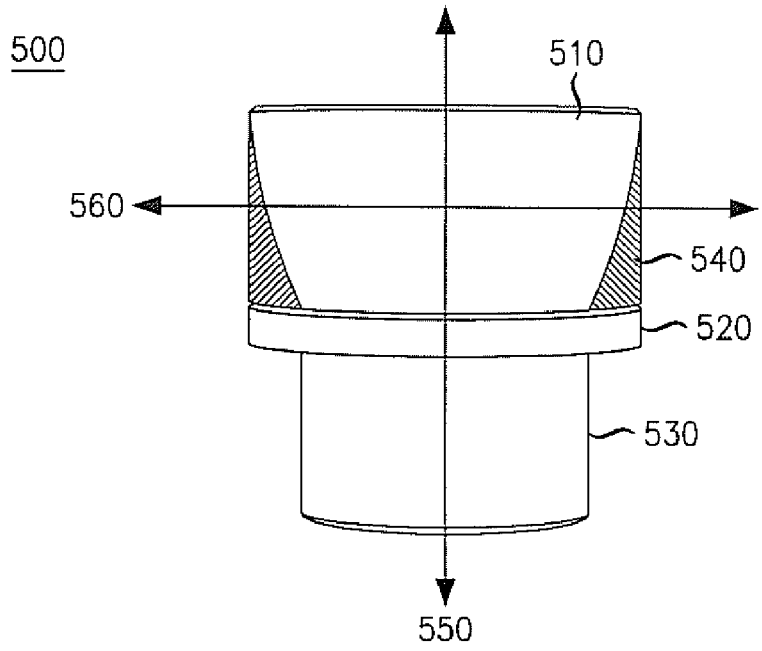
FIG. 3 shows a side view of a second exemplary dielectric resonator.

FIG. 3 shows a side view of a second exemplary dielectric resonator 300. Resonator 300 comprises a puck 310, a temperature compensation structure 320, and a support 330. Unlike temperature compensation structure 220, temperature compensation structure 320 may have an extension 340 disposed on or formed integrally with support 330. Support 330 may have a cylindrical surface, wherein a vertical axis 350 of support 330 may be perpendicular to a horizontal axis 360 of puck 310. As described above, there may be a plurality of supports disposed at various locations within the cavity of resonator 300.

In an exemplary case where support 330 is a cylinder, extension 340 may be extruded in a three-dimensional manner around support 330 in a way that maximizes the contacting surface area between temperature compensation structure 320 and support 330. Thus, extension 340 may gradually taper from a maximum width at the bottom surface of temperature compensation structure 320 in a conical manner, wherein a vertical axis 350 of support 330 would act as the central axis of the cone. In the two-dimensional projection of FIG. 3, each nappe of this conical surface respectively appears as a triangle on either the left or right side of support 330.

The two nappes cannot form a complete cone because a conductive wall defines an external surface of the cavity for resonator 300. Consequently, the two nappes defined by extension 340 cannot meet at a single point to define a complete cone. Moreover, the nappes may end at some point above the conductive wall, only partially extending along the length of support 330. In either case, extension 340 may have the shape of a truncated cone, so they may be described as frustoconical surfaces. Other surfaces that are substantially flat, having a Gaussian curvature near zero, may be used, as will be apparent to those having ordinary skill in the art.

Extension 340 may thereby increase the surface area of the thermal interface between temperature compensation structure 320 and support 330. Because the surface areas are similar, thermal spreading resistance to heat flowing from temperature compensation structure 320 into support 330 will be minimal. The nappes in extension 340 will allow heat to flow inward into support 330 from the surrounding temperature compensation structure 320, increasing thermal efficiency.

Figure 4:
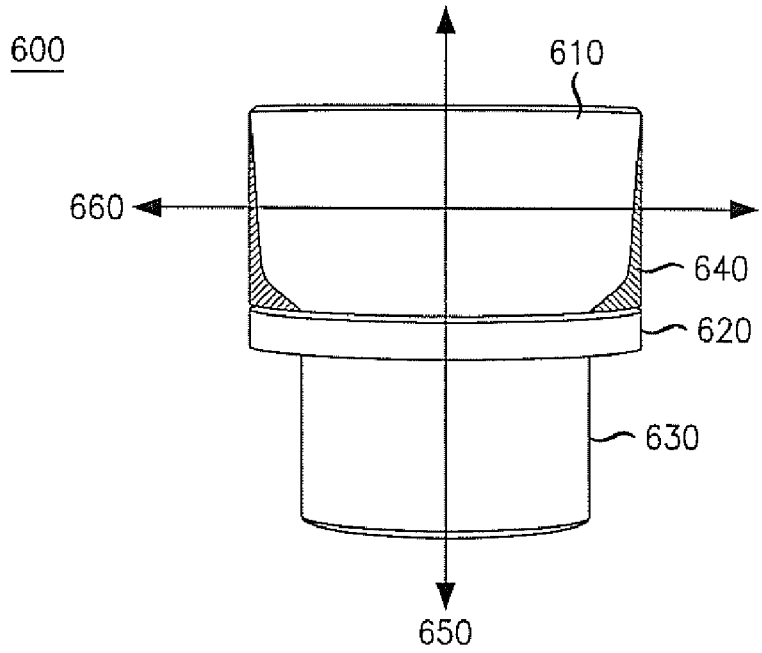
FIG. 4 shows a side view of a third exemplary dielectric resonator.

FIG. 4 shows a side view of a third exemplary dielectric resonator 400. Resonator 400 comprises a puck 410, a temperature compensation structure 420, and a support 430. Support 430 may have a cylindrical surface, wherein a vertical axis 450 of support 430 may be perpendicular to a horizontal axis 460 of puck 410. As described above, there may be a plurality of supports disposed at various locations within the cavity of resonator 400.

Unlike temperature compensation structure 220, temperature compensation structure 420 has a curved extension 440, which may be disposed on or integral with support 430. This extension 440 may have a negative Gaussian curvature, curving inward rather than outward or being straight. Thus, extension 440 may be described as having hyperboloid surfaces.

Extension 440 may be extruded in a three-dimensional manner around support 430 in a way that maximizes the contacting surface area between temperature compensation structure 420 and support 430. The hyperboloid surfaces of extensions 440 may be disposed along at least part of the support 430, wherein a central axis of the hyperboloid surfaces is the vertical axis 450 of the support 430. Because extension 440 may have a negative curvature, extension 440 may more efficiently promote heat transfer if puck 410 is convex. Conversely, extension 440 could have a positive curvature if puck 410 were concave.

FIG. 5 shows a side view of a fourth exemplary dielectric resonator 500. Resonator 500 comprises a puck 510, a temperature compensation structure 520, and a support 530. Support 530 may have a cylindrical surface, wherein a vertical axis 550 of support 530 may be perpendicular to a horizontal axis 560 of puck 510. As described above, there may be a plurality of supports disposed at various locations within the cavity of resonator 500.

Temperature compensation structure 520 may have an extension 540 extruded in a three-dimensional manner around puck 510 in a way that maximizes the contacting surface area between puck 510 and temperature compensation structure 520. Extension 540 may gradually taper from a maximum width at a top surface of temperature compensation structure 520 in a conical pattern, wherein a horizontal axis 560 of puck 510 would be perpendicular to the central axis of the cone. In the two-dimensional projection of FIG. 5, each nappe of this conical surface respectively appears as a triangle on either the left or right side of puck 510.

The two nappes cannot form a complete cone as they cannot extend beyond the distal surface of puck 510. Moreover, the nappes may end at some point below the distal surface of puck 510. In either case, extension 540 may have the shape of a truncated cone, so it may be described as a frustoconical surface. Other shapes may be used, as will be apparent to those having ordinary skill in the art.

As another example, extension 540 may be extruded in a three-dimensional manner around 510 in a way that maximizes the contacting surface area between puck 510 and temperature compensation structure 520 without using a conical pattern. Extension 540 may form a cuplike structure around puck 510, absorbing heat radiated from both the proximal surface of puck 510 and any sidewalls of puck 510. Thus, heat may flow from both the left side of the puck 510 and the right side of the puck 510 into temperature compensation structure 520. As the contiguous surface area may be larger than when using a single contiguous surface that is flat, the fourth exemplary dielectric resonator 500 may have improved heat transfer.

FIG. 6 shows a side view of a fifth exemplary dielectric resonator 600. Resonator 600 comprises a puck 610, a temperature compensation structure 620, and a support 630. Support 630 may have a cylindrical surface, wherein a vertical axis 650 of support 630 may be perpendicular to a horizontal axis 660 of puck 610. As described above, there may be a plurality of supports disposed at various locations within the cavity of resonator 600.

Temperature compensation structure 620 may have a curved extension 640 disposed on the proximal surface of the puck 610. Thus, heat will flow from the proximal surface of puck 610 into the internal surface of temperature compensation structure 520. As the contiguous surface area may be larger between curved extension 640 and puck 610 than when using a single contiguous surface that is flat, the fifth exemplary dielectric resonator 600 may have faster heat transfer than the first exemplary dielectric resonator 200.

Curved extension 640 may have a negative Gaussian curvature. Thus, extension 640 may have hyperboloid surfaces disposed along at least part of the puck 610, wherein a central axis of the hyperboloid surfaces may be perpendicular to the horizontal axis 660 of the puck 610. The hyperboloid surfaces of extension 640 may also narrow in a direction toward the distal surface of the puck 610.

Extension 640 may have a concave curvature and may extend to the distal surface of puck 610. For this alternative, puck 610 may have a proximal surface that is hemispherical or ellipsoidal, thereby radiating heat in an even manner. In this case, the concave curvature of extension 640 may match the convex, proximal surface of puck 610, allowing heat to rapidly flow out of puck 610.

Figure 7:
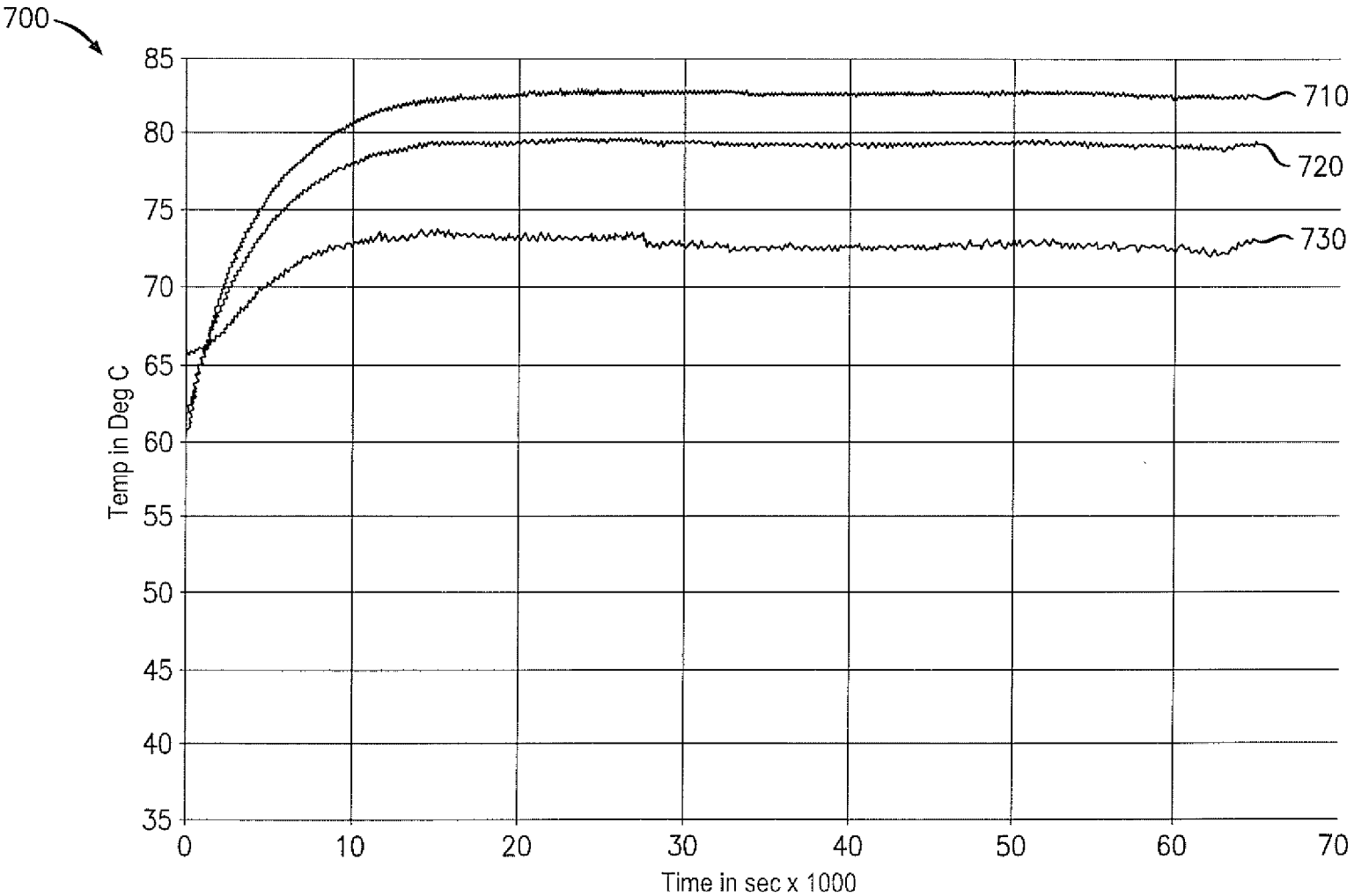
FIG. 7 depicts comparative test results for an exemplary dielectric resonator and two conventional dielectric resonators.

FIG. 7 depicts comparative test results 700 for an exemplary dielectric resonator and two conventional dielectric resonators. FIG. 7 provides simulations and measurements from electrical test results 700 in a graphical format. The x-axis of the graph lists time in milliseconds, ranging from 0 to 70 ms. The y-axis of the graph lists temperature in degrees Celsius, ranging from 35° C. to 85° C. These temperatures are measured in the center of a puck within the cavity defining a dielectric resonator.

A first example 710 depicts a temperature curve for a first conventional dielectric resonator. In this example, the contact surface area between the puck and its corresponding support may be about 1.08 square inches. Within 10 ms, operation of the dielectric resonator causes the puck to warm from about 60° C. to over 80° C. A 20° C. increase in temperature may damage the puck or impair operation of the resonator.

A second example 720 depicts a temperature curve for a second conventional dielectric resonator. In this example, the contact surface area between the puck and its corresponding support may be about 2.65 square inches. Because the contact surface area is larger, one of ordinary skill in the art would expect more rapid heat transfer to occur between the puck and its support. Nevertheless, operation of this dielectric resonator still causes the puck's temperature to rise to nearly 80° C. Such rapid heating may distort frequency performance of the resonator.

A third example 730 depicts a temperature curve for an exemplary dielectric resonator having a temperature compensation structure according to an embodiment disclosed herein with respect to FIG. 2. The contact surface area is about 5.34 square inches, considerably larger than for either example 710 or example 720. While a temperature buildup still occurs, the puck's temperature never rises above 75° C. Consequently, the exemplary dielectric resonator may be much more effective than the conventional resonators of example 710 and example 720.

It should be apparent to those of skill in the art that the embodiments described above may be used in various combinations. For example, extensions 340 of FIG. 3 could be added to extensions 540 of FIG. 5. Alternatively, extensions 440 of FIG. 4 could be added to extensions 640 of FIG. 6. Other suitable arrangements and modifications for increasing the contact surface area will be apparent to those of skill in the art.

Although the various exemplary embodiments have been described in detail with particular reference to certain exemplary aspects thereof, it should be understood that the invention is capable of other embodiments and its details are capable of modifications in various obvious respects. As is readily apparent to those skilled in the art, variations and modifications can be affected while remaining within the spirit and scope of the invention. Accordingly, the foregoing disclosure, description, and figures are for illustrative purposes only and do not in any way limit the invention, which is defined only by the claims.

What is claimed is:

1. A system for heat transfer in a communication device, the system comprising:

a dielectric resonator that generates heat when the communication device is active, the dielectric resonator comprising a puck having a distal surface and a proximal surface that is located within a cavity defined by at least one conductive wall, wherein the puck does not contact the at least one conductive wall;

a temperature compensation structure having an internal surface, an external surface that transfers the generated heat away from the dielectric resonator by having the internal surface in contact with the proximal surface of the puck, and an elongated extension having a long axis perpendicular to the proximal surface of the puck, wherein the internal surface of the temperature compensation structure and the proximal surface of the puck have substantially equal surface areas; and a support adjacent to the temperature compensation structure that receives the transferred heat from the external surface of the temperature compensation structure, wherein the support contacts the at least one conductive wall and has a vertical axis perpendicular to a horizontal axis in the puck.

2. The system of claim 1, wherein the elongated extension is shaped as a frustum that defines frustoconical surfaces along at least part of the support, wherein a central axis of the frustum is the vertical axis of the support.

3. The system of claim 2, wherein the frustoconical surfaces taper along the vertical axis of the support in a direction toward the at least one conductive wall.

4. The system of claim 1, wherein the elongated extension has curved hyperboloid surfaces disposed along at least part of the support, wherein a central axis of the elongated extension is the vertical axis of the support.

5. The system of claim 4, wherein the hyperboloid surfaces narrow along the vertical axis of the support in a direction toward the at least one conductive wall.

6. The system of claim 1, wherein the elongated extension is shaped as a frustum that defines frustoconical surfaces along at least part of the puck, wherein a central axis of the frustum is perpendicular to the horizontal axis of the puck.

7. The system of claim 6, wherein the frustoconical surfaces taper in a direction toward the top surface of the puck.

8. The system of claim 1, wherein the elongated extension has curved hyperboloid surfaces disposed along at least part of the puck, wherein a central axis of the elongated extension is perpendicular to the horizontal axis of the puck.

9. The system of claim 8, wherein the hyperboloid surfaces narrow in a direction toward the top surface of the puck.

10. The system of claim 1, the system further comprising:

a plurality of supports and thermal compensation structures, wherein the internal surface of each thermal compensation structure receives heat from the puck and the external surface of each thermal compensation structure transfers the received heat to a respective support.

11. A dielectric filter having thermally efficient heat transfer, the dielectric filter comprising:

a plurality of dielectric resonators; and an aperture between the plurality of dielectric resonators, wherein each dielectric resonator comprises:

a cavity defined by at least one conductive wall;

a puck having a distal surface and a proximal surface that is located within the cavity, wherein the puck does not contact the at least one conductive wall;

a temperature compensation structure having an internal surface and an external surface that transfers the generated heat away from the dielectric filter by having the internal surface in contact with the proximal surface of the puck, and an elongated extension having a long axis perpendicular to the proximal surface of the puck, wherein the internal surface of the temperature compensation structure and the proximal surface of the puck have substantially equal surface areas; and a support below the temperature compensation structure that receives the transferred heat from the external surface of the temperature compensation structure, wherein the support contacts the at least one conductive wall and has a vertical axis perpendicular to a horizontal axis in the puck.

12. The dielectric filter of claim 11, wherein elongated extension is shaped as a frustum that defines frustoconical surfaces along at least part of the support, wherein a central axis of the frustum is the vertical axis of the support.

13. The dielectric filter of claim 12, wherein the frustoconical surfaces taper along the vertical axis of the support in a direction toward the at least one conductive wall.

14. The dielectric filter of claim 11, wherein the elongated extension has curved hyperboloid surfaces disposed along at least part of the support, wherein a central axis of the elongated extension is the vertical axis of the support.

15. The dielectric filter of claim 14, wherein the hyperboloid surfaces narrow along the vertical axis of the support in a direction toward the at least one conductive wall.

16. The dielectric filter of claim 11, wherein the extension is shaped as a frustum that defines frustoconical surfaces along at least part of the puck, wherein a central axis of the frustum is perpendicular to the horizontal axis of the puck.

17. The dielectric filter of claim 16, wherein the frustoconical surfaces taper in a direction toward the top surface of the puck.

18. The dielectric filter of claim 11, wherein the elongated extension has curved hyperboloid surfaces disposed along at least part of the puck, wherein a central axis of the elongated extension is perpendicular to the horizontal axis of the puck.

19. The dielectric filter of claim 18, wherein the hyperboloid surfaces narrow in a direction toward the top surface of the puck.

20. The dielectric filter of claim 11, the dielectric filter further comprising:

a plurality of supports and thermal compensation structures, wherein the internal surface of each thermal compensation structure receives heat from the puck and the external surface of each thermal compensation structure transfers the received heat to a respective support.

* * * * *